US005898275A

United States Patent [19]

Taillie et al.

[11] Patent Number: 5,898,275

[45] Date of Patent: Apr. 27, 1999

[54] FLUORESCENT LAMP SYSTEM INCLUDING LIGHT BLOCKING MEMBERS TO CREATE UNIFORM ILLUMINATION ALONG A FLORESCENT LAMP

[75] Inventors: Joseph P. Taillie, Pittsford; Douglas E. Proctor, Gates, both of N.Y.

[73] Assignee: Xerox Corporation, Stamford, Conn.

[21] Appl. No.: 08/842,547

[22] Filed: Apr. 15, 1997

[51] Int. Cl.[6] ..... H01J 7/24

[52] U.S. Cl. ..... 315/115; 315/32; 315/49; 362/351

[58] Field of Search ..... 315/115, 32, 49, 315/50, 58, 71; 313/493, 609, 610, 15, 488; 362/351, 353; 361/826; 355/30, 228

[56] References Cited

U.S. PATENT DOCUMENTS

| | | | |
|---|---|---|---|
| 3,887,816 | 6/1975 | Colley | 250/571 |
| 4,248,517 | 2/1981 | Nishikawa | 355/1 |
| 5,029,311 | 7/1991 | Brandkamp et al. | 355/30 |
| 5,189,340 | 2/1993 | Ikeda | 315/116 |
| 5,282,117 | 1/1994 | Fritts | 362/223 |
| 5,616,989 | 4/1997 | Tallie et al. | 315/32 |
| 5,645,337 | 7/1997 | Gleckman | 362/29 |

*Primary Examiner*—Don Wong
*Assistant Examiner*—Haissa Philogene
*Attorney, Agent, or Firm*—Michael J. Nickerson

[57] ABSTRACT

A fluorescent light source includes a fluorescent lamp, lamp bases attached to opposite ends of the fluorescent lamp, and an electrically insulating substrate connected to the fluorescent lamp. A heating element is positioned on the fluorescent lamp, and a first and second pair of power traces are formed on the electrically insulating substrate. The first pair of power traces are connected to the heating element to provide power thereto. The second pair of power traces are connected to a pair of electrical conductors that provide power to the fluorescent lamp. This fluorescent lamp can be used in a replaceable fluorescent light source unit for a document scanner. The replaceable fluorescent light source unit includes a housing, lamp base receiving members attached to the housing, and registration notches to properly align the fluorescent lamp. Lastly, the fluorescent lamp source includes light blocking material to provide a uniform illumination profile along the length of the lamp.

23 Claims, 7 Drawing Sheets

FIG. 2
(CONVENTIONAL ART)
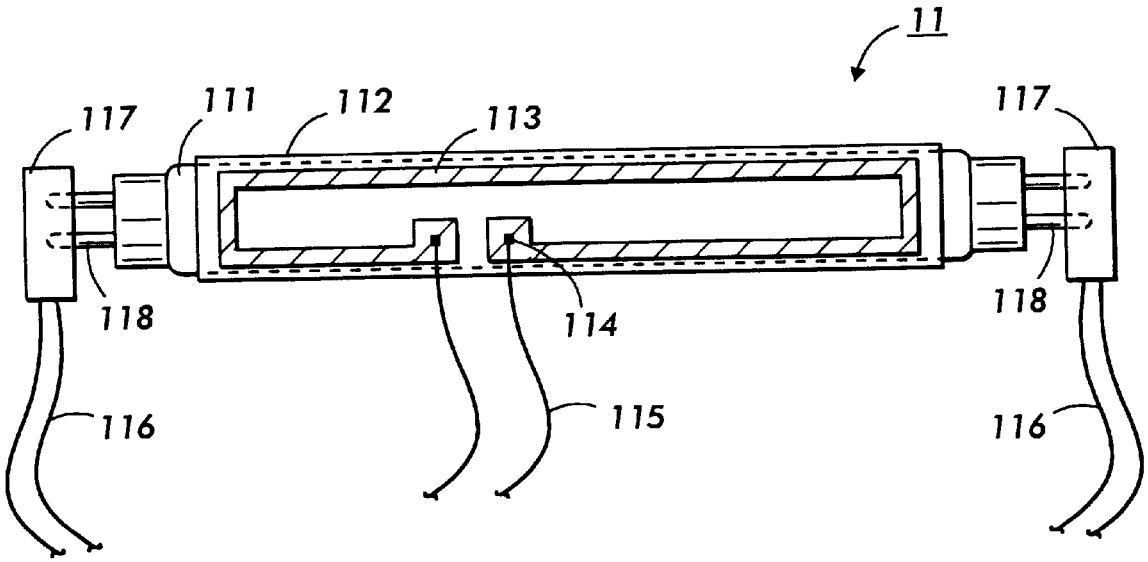
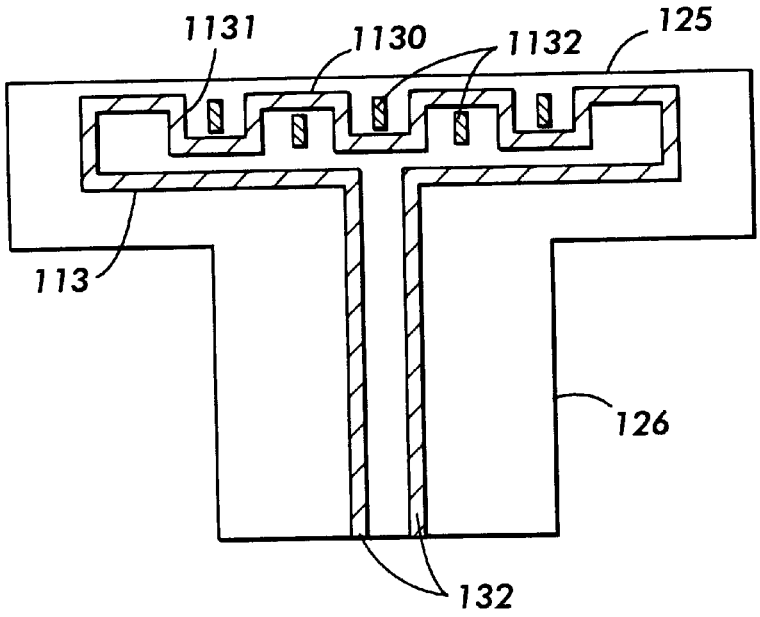
FIG. 3

FIG. 4
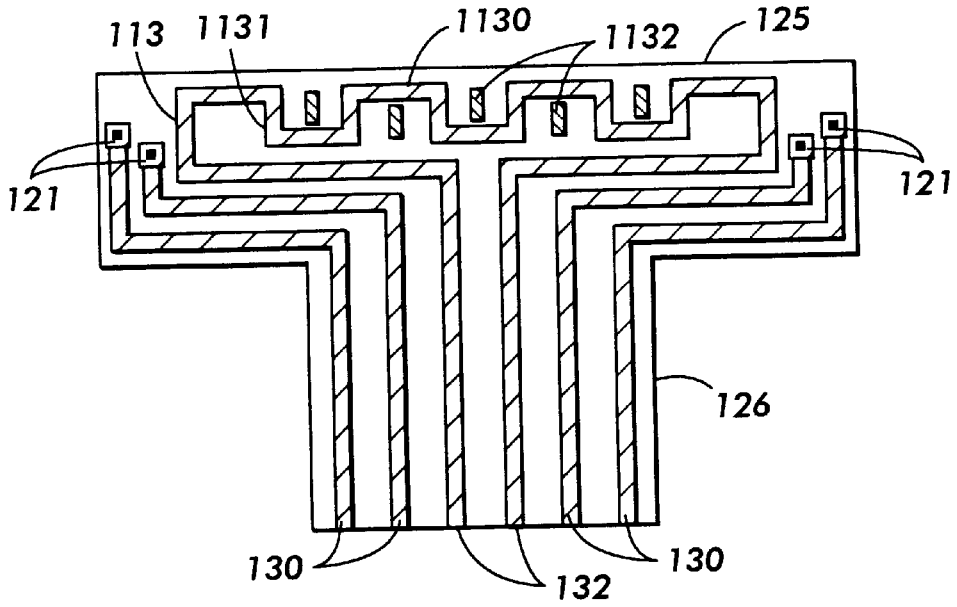
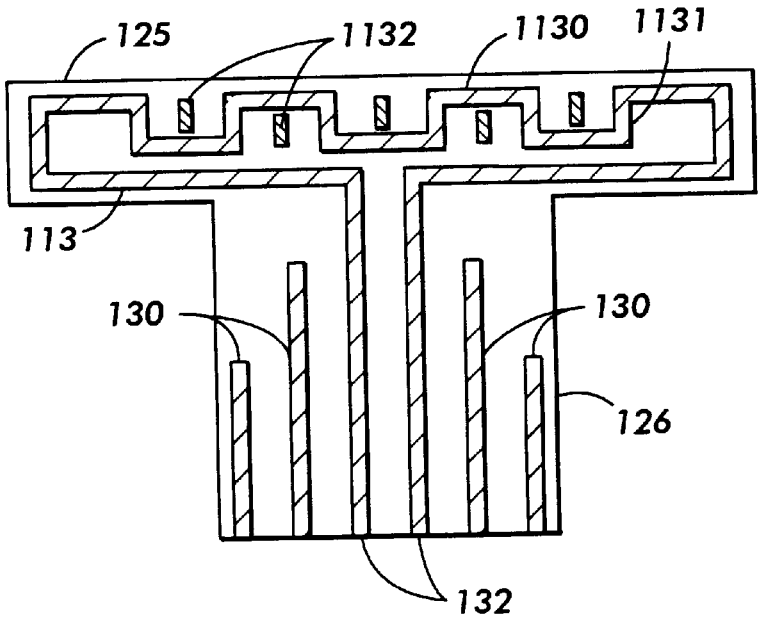
FIG. 5

FIG. 6
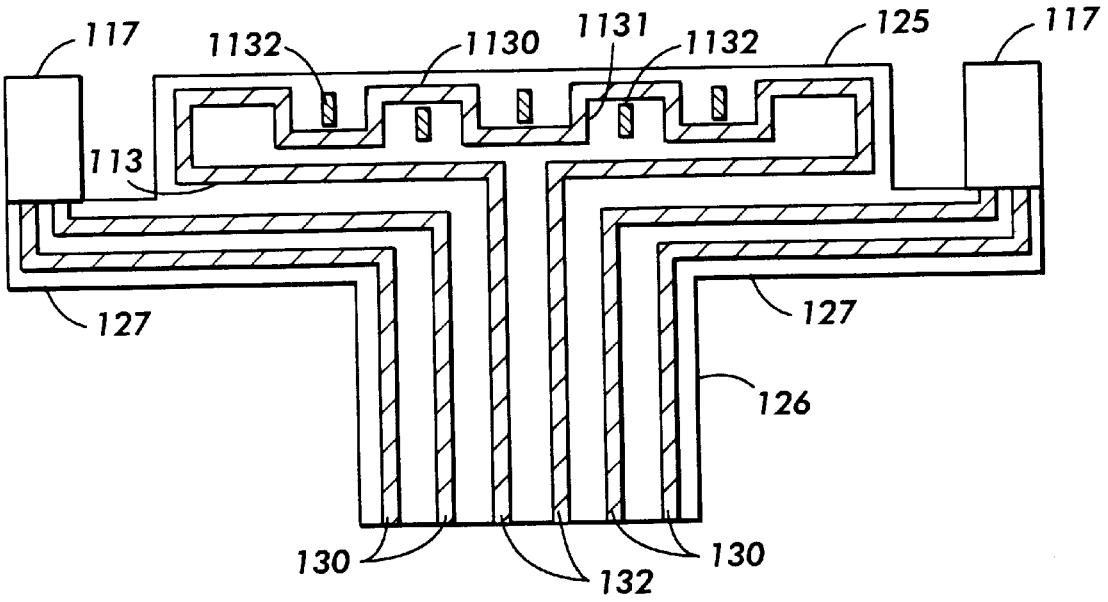
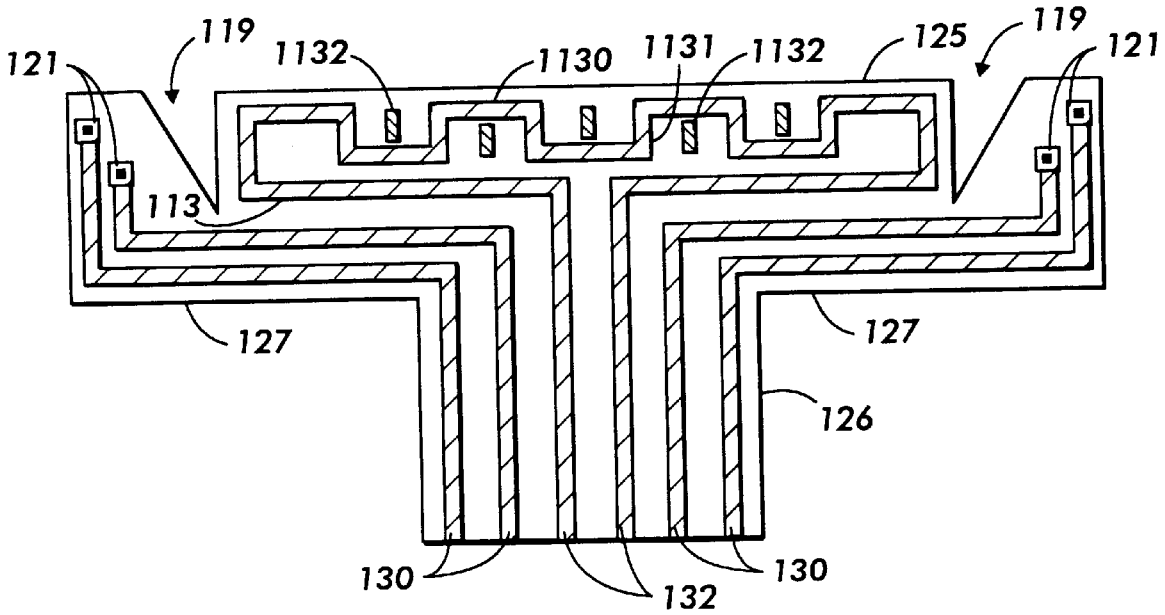
FIG. 7

FIG. 8
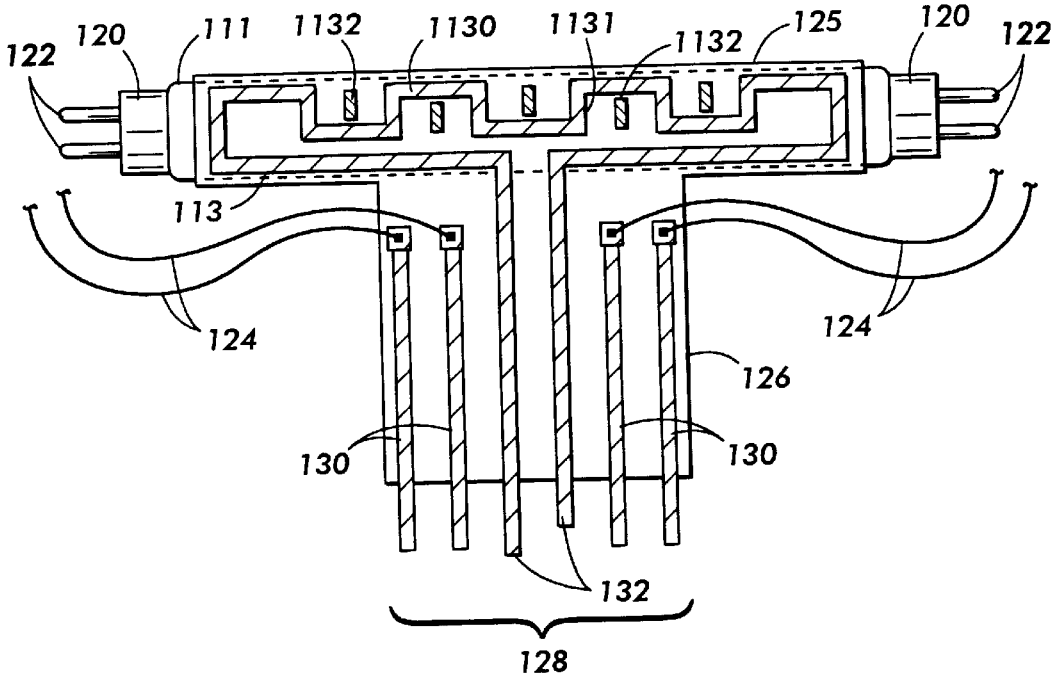
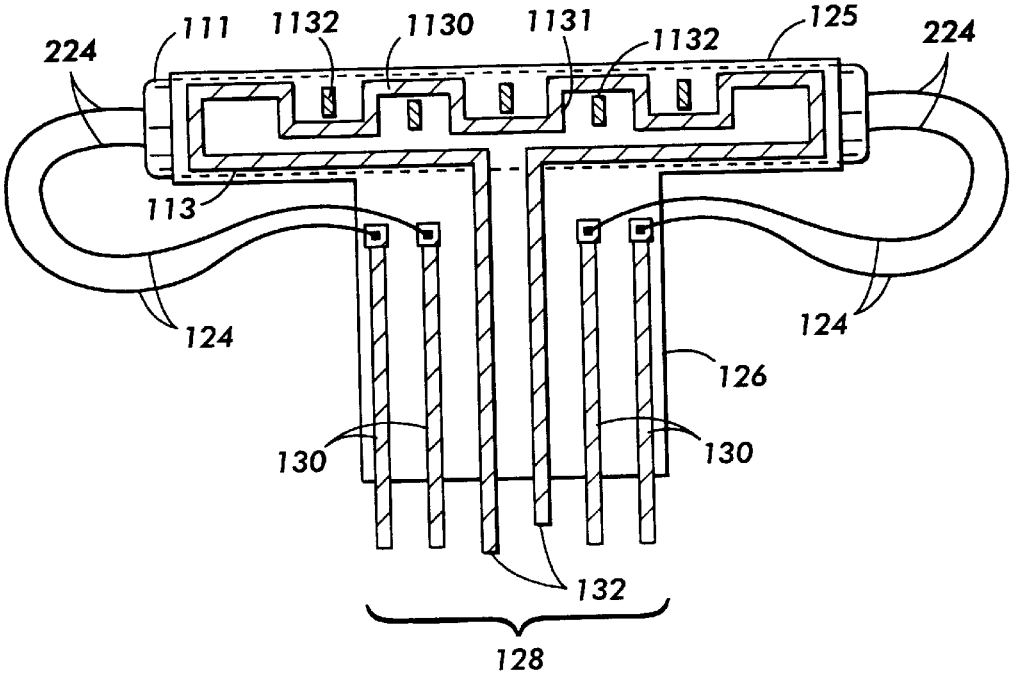
FIG. 9

FLUORESCENT LAMP SYSTEM INCLUDING LIGHT BLOCKING MEMBERS TO CREATE UNIFORM ILLUMINATION ALONG A FLORESCENT LAMP

FIELD OF THE PRESENT INVENTION

The present invention is directed to a fluorescent lamp for a document scanner that includes light blocking members. More specifically, the present invention is directed to a fluorescent lamp which includes light blocking members that are formed on a lamp heating harness so that the illumination provided by the fluorescent lamp is uniform along its length.

BACKGROUND ON THE PRESENT INVENTION

FIG. 1 illustrates a conventional document scanner. In the conventional scanner, a light source 11 is used to illuminate a document 3 having an image thereon. The conventional document scanner also includes a glass platen 5 upon which the document 3 rests and a platen cover 1. FIG. 1 also shows the angle of reflection center line 9 for the conventional document scanner.

To scan the image on the document, the light source 11 illuminates the document 3 through the glass platen 5 such that the light reflected from the document 3 passes through on optical lens system 7. The optical lens system 7 directs the reflected light to either a photosensitive recording medium, a CCD sensor, or a full width array sensor. If the reflected light is directed to a photosensitive recording medium, a latent image of the document 3 is developed thereon and is subsequently transferred to a copy substrate. On the other hand, if the reflected light is directed to a CCD sensor or a full width array sensor, the light reflected from the document 3 is converted into electronic signals forming image data which electronically represent the document 3.

To provide a full scanning of the document 3, either the document 3 is moved relative to the light source 11 and the components which receive the reflected light, or the light source 11 and the components receiving the reflected light are moved relative to the document 3.

FIG. 2 illustrates, in more detail, the light source 11 for a conventional document scanner. This conventional light source includes a fluorescent lamp 111 which produces the light coming from the light source 11. Attached to either end of the fluorescent lamp 111 are lamp bases 110 which include electrical pins 118. These electrical pins provide an electrical conduit for the fluorescent lamp so that the fluorescent lamp can receive the proper electrical power. These pins 118 also provide mechanical support by holding the fluorescent lamp 111 securely in place.

For the fluorescent lamp to be fully functional and secure, the pins 118 are placed into fluorescent lamp holders 117 which provide the mechanical support for the fluorescent lamp as well as the electrical terminals which provide the electrical power to the fluorescent lamp. The fluorescent lamp holders 117 are each connected to a pair of electrical leads 116 which are in turn connected to a power source.

The fluorescent lamp 111 is also substantially covered by a heater blanket 112 which includes a heater element 113. The heater blanket 112 may include a small slit or be transparent to allow the light produced by the fluorescent 111 to pass through the heater blanket 112 and illuminate the document 3. The heater blanket 112 is provided to prevent undesirable cold spots within the fluorescent lamp and to enable the fluorescent lamp to produce a more stabilized light.

The heating element 113 is connected to a power source through contacts 114 and electrical leads 115. Thus, to properly assemble a conventional light source in a conventional document scanner, the fluorescent lamp 111 is placed in the fluorescent lamp holders 117 and the leads 115 are soldered to the heating element at contacts 114 located on the heater blanket 112.

Utilizing such a conventional light source as described above, with respect to FIGS. 1 and 2, the illumination of a document in a uniform manner becomes problematic. More specifically, in document illumination with a fluorescent lamp, the uniformity of document illumination in the axial direction depends on the length of the lamp. By extending the lamp well beyond the edge of the document, uniformity can be improved but his forces the size of the machine to grow in many cases.

For example, the illumination on a plane close to a fluorescent lamp is approximately uniform near the center and falls off toward the ends. The exact rate of decrease is dependent on the physical construction of the lamp, that is the diameter, electrode placement, filament size and shape, etc. In document illumination applications such as copier machines, it is common to extend the lamp well beyond the edge of the document to minimize the effect of the non-uniformity on copy quality. In electronic scanners, where there is often some electronic means of correcting for non-uniformity, it is still helpful to reduce the amount of falloff, particularly when other sources of non-uniformity are present. An example of such other sources is the relative illumination falloff due to the lens, commonly referred to as $\cos^4 \theta$ falloff.

Several methods exist for reducing the end falloff. Light/lens reprographic machines typically use a butterfly slit, wider at the ends than the center to allow a longer exposure time as the image is scanned. End reflectors have been used to create a virtual image of the lamp, making the lamp appear to be longer. Light/lens reprographic machines and electronic scanners have used relative illumination filters and blockers in the imaging path to change the apparent shape or transmittance of the lens depending on axial position. Such blocking features have included variable coverage halftone patterns on the lamp to reduce the illumination in the center.

However, in the document scanner environment, such solutions may not readily solve the problem. Such scanners image a narrow line, typically 0.06 mm, so methods involving slits etc. to vary the exposure tile along the line would require unrealistic precision. Using a variable width slit directly on the lamp is possible. With aperture lamps normally used for document illumination, however, this will have the undesirable effect of changing the transverse illumination profile, and so the positional tolerances of illuminator components.

Therefore, it is desirable to provide profile correction without adjusting the slit's width or other dimensions of the lamp. More particularly, it is preferred to vary the "apparent" slit length along the lamp by using blocking features that are perpendicular to the lamp's axis.

SUMMARY OF THE PRESENT INVENTION

One aspect of the present invention is a lamp harness assembly. The lamp assembly includes a heating element; a plurality of light blocking elements; and an electrically insulating substrate. The electrically insulating substrate has the heating element and the plurality of light blocking elements formed thereon.

Another aspect of the present invention is a lamp harness assembly. The lamp harness assembly includes a heating element; heating element power traces; a plurality of light blocking elements; and an electrically insulating substrate. The electrically insulating substrate has the heating element, heating element power traces, and the plurality of light blocking elements formed thereon. The electrically insulating substrate includes a lamp portion having the heating element and the plurality of light blocking elements formed thereon, and a tail portion having the heating element power traces formed thereon. The tail portion extends away from the lamp portion to provide an electrical connection to a power source.

A third aspect of the present invention is a fluorescent light source. The fluorescent light source includes a fluorescent lamp; an electrically insulating substrate connected to the fluorescent lamp; a heating blanket positioned on the fluorescent lamp, having a heating element; a plurality of light blocking elements positioned on the heating blanket; a first pair of power traces formed on the electrically insulating substrate and connected to the heating element to provide power thereto; a second pair of power traces formed on the electrically insulating substrate; and a pair of electrical conductors connected to the second pair of power traces to provide power to the fluorescent lamp.

A fourth aspect of the present invention is an illumination source. The illumination source includes a fluorescent lamp and a plurality of light blocking elements. The plurality of light blocking elements are positioned in close proximity to the fluorescent lamp. Each light blocking element has a length dimension and a width dimension. The plurality of light blocking elements are positioned such that the length dimension is perpendicular to an axis of the fluorescent lamp.

A fifth aspect of the present invention is a fluorescent lamp assembly. The fluorescent lamp assembly includes a fluorescent lamp; a plurality of light blocking elements; and a heating blanket. The plurality of light blocking elements are positioned in close proximity to the fluorescent lamp. Each light blocking element has a length dimension and a width dimension. The plurality of light blocking elements being positioned such that the length dimension is perpendicular to an axis of the fluorescent lamp.

A sixth aspect of the present invention is a replaceable fluorescent light source unit. The replaceable fluorescent light source unit includes a housing; lamp base receiving members attached to the housing; a fluorescent lamp having lamp bases attached to opposite ends thereof and removably attached to the lamp base receiving members; an electrically insulating substrate connected to the fluorescent lamp; a heating element positioned on the fluorescent lamp; a first pair of power traces formed on the electrically insulating substrate and connected to the heating element to provide power thereto; a second pair of power traces formed on the electrically insulating substrate; a pair of electrical conductors connected to the second pair of power traces and one of the lamp base receiving means to provide power to the fluorescent lamp; and a plurality of light blocking elements. The plurality of light blocking elements are positioned in close proximity to the fluorescent lamp. Each light blocking element has a length dimension and a width dimension. The plurality of light blocking elements being positioned such that the length dimension is perpendicular to an axis of the fluorescent lamp.

Further objects and advantages of the present invention will become apparent from the following description of the various features of the present invention.

BRIEF DESCRIPTION OF THE DRAWINGS

The following is a brief description used in describing the present invention, and thus, are being presented for illustrative purposes only and should not be limitative of the scope of the present invention, wherein:

FIG. 2 illustrates a conventional light source for a document scanner;

FIG. 3 illustrates a heater power harness assembly according to the concepts of the present invention;

FIG. 4 illustrates one embodiment of a heater/lamp power harness according to the concepts of the present invention;

FIG. 5 illustrates a second embodiment of a heater/lamp power harness according to the concepts of the present invention;

FIG. 6 illustrates a third embodiment of a heater/lamp power harness with lamp holders according to the concepts of the present invention;

FIG. 7 illustrates a fourth embodiment of a heater/lamp power harness according to the concepts of the present invention;

FIG. 8 illustrates a light source for a document scanner according to one embodiment of the present invention;

FIG. 9 illustrates a light source for a document scanner according to another embodiment of the present invention;

DETAILED DESCRIPTION OF THE DRAWINGS

Figure 1:
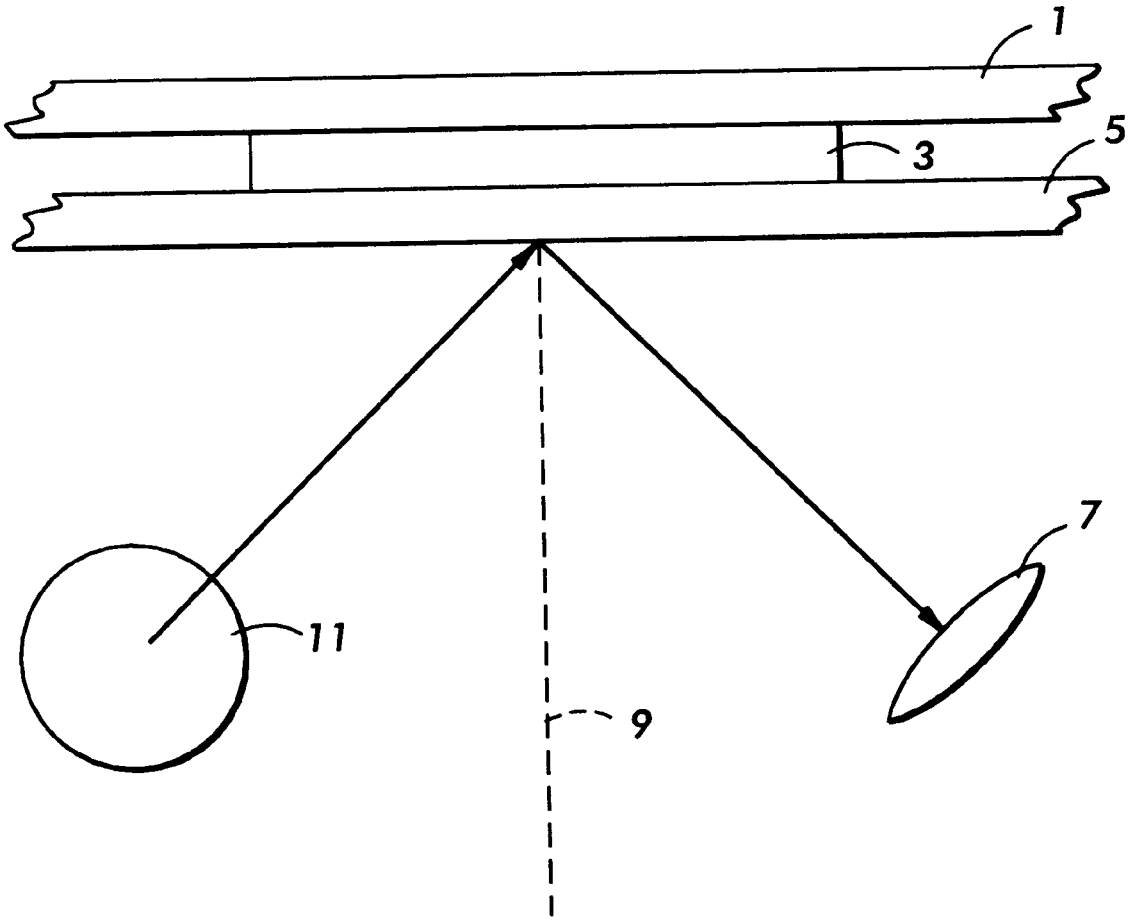
FIG. 1 (CONVENTIONAL ART)
FIG. 1 illustrates a conventional illumination system for a document scanner.

For a general understanding of the present invention, reference is made to the drawings. In the drawings, and in the specification, like reference numerals have been used throughout to designate identical or equivalent elements or steps.

Figure 11:
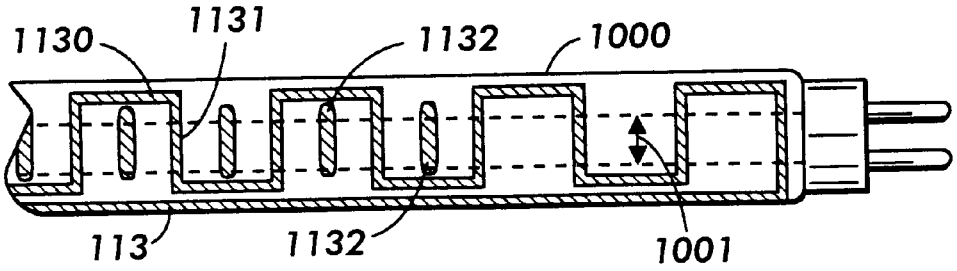
FIG. 11 illustrates an enlarged view of a preferred embodiment of the present invention.

As noted above, it is desirable to provide a light blocking material on the lamp to enable a uniform illumination profile along the length of the lamp. FIG. 11 illustrates an embodiment that realizes this result.

As illustrated in FIG. 11, fluorescent lamps often use a heater blanket 1000 to aid in controlling the lamp's output. In the preferred embodiment, the heater blanket 1000 is transparent, with narrow metal resistive traces 1130 and 1131 forming the heater element 113. The traces 1130 and 1131 are formed photolithgraphically from a metal coated clear substrate to form a S-shaped pattern that traverses substantially the entire lamp. More specifically, traces 1131 run perpendicular to the lamp's axis, while the traces 1130 run parallel to the lamp's axis.

The substrate is then adhesively bonded to the lamp. In addition to the traces 1130 and 1131, the heating blanket includes areas of metal 1132, electrically isolated from the heater traces 1130 and 1131, for the purpose of blocking light. In the preferred embodiment of the present invention, the light blocking material 1132 are formed across a slit 1001 of the fluorescent lamp. The fractional area of the metal 1132 left is proportional to the amount of profile correction to be made.

For example, if the heater traces are 1 mm wide and spaced on 10 mm centers, and if it is desired to correct for 20% falloff, the areas of metal to be added should be 20%*(10 mm-1 mm)=1.8 mm wide. At the end of the lamp, the areas remain unblocked to compensate for the falloff.

Figure 12:
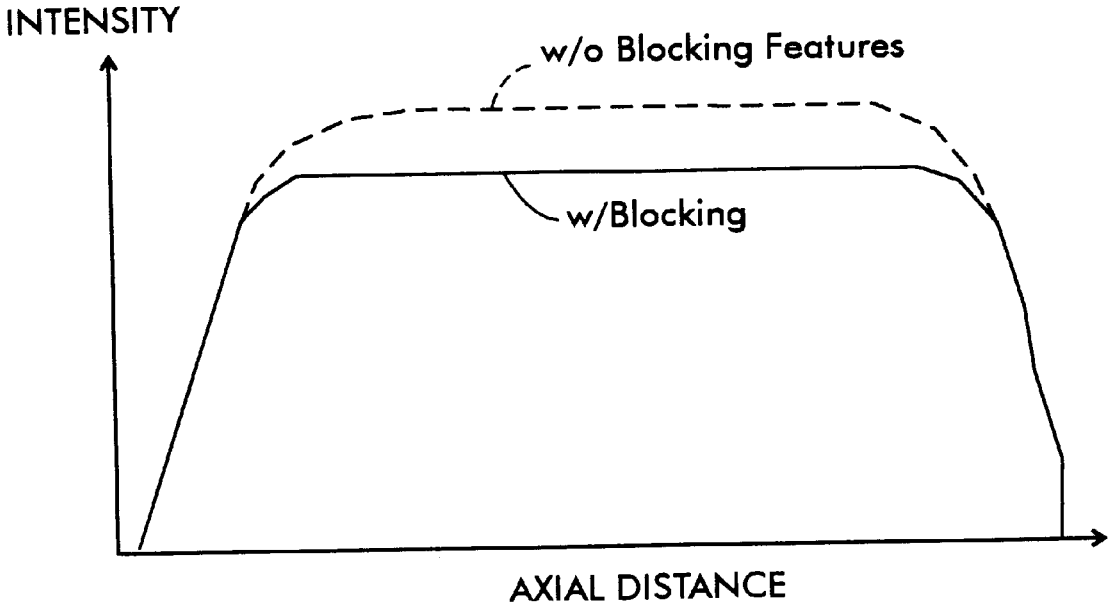
FIG. 12 is a graphical representation of an illumination profile for a fluorescent lamp with and without the blocking features of the present invention.

The results from utilizing the heater blanket as described above with respect to FIG. 11 is illustrated in FIG. 12. More specifically, with this particular heater, light is intentionally blocked everywhere along the heater in order to reduce the document illumination. In the end areas, the size of the blocking features is reduced to provide an increase in the illumination. Using this approach, as illustrated in FIG. 12 the profile length can be increased. For example, the profile length can be increased from 169 mm to 179.5 mm at 10% falloff. Further improvement can be achieved by further reducing the size of the end features.

The amount of profile correction determines the fractional area coverage, or relative size, of the blocking features. The actual dimensions chosen will be dependent on the details of the particular illuminator, however, if the features get too long, the blocking features will introduce a modulation into the profile that would be undesirable.

FIG. 3, as noted above, illustrates a heater power harness for a fluorescent lamp. In this embodiment, the heater power harness includes an electrically insulating substrate 125 upon which a heating element 113 is formed. The heating element 113, in the form of a heating blanket, surrounds essentially an entire fluorescent lamp except for a small slit which enables the light produced by the fluorescent lamp 111 to pass therethrough and illuminate the document being scanned. In an alternative preferred embodiment, the heating blanket surrounds the entire fluorescent lamp and is substantially transparent so as to enable the light produced by the fluorescent lamp 111 to pass therethrough and illuminate the document being scanned.

The electrically insulating substrate 125 also has formed upon it a pair of power traces 132 which form an electrical path to supply power to the heating element 113. The electrically insulating substrate 125 has two integral portions, a lamp portion which provides electrical insulation and support for the heating element 113 and a tail portion 126 ("harness tail 126") which provides electrical insulation and support for the heating element power traces 132 and enables the heating element power traces 132 to be lead away from the heating element portion. The harness tail 126 may have a connector placed at its end (not shown) so as to enable connection to a power source. In the preferred embodiment, the end of the harness tail 126 is stripped leaving bare traces. These traces are then inserted into the power source when the tail is long enough or into a scan cord when the tail is short.

The harness tail 126 may be short so that a cord is required from the power source to the connector on the end of the harness tail 126, or the harness tail 126 may be long enough to provide a direct power path from the power source to the lamp. The length of the harness tail may be adjusted to meet the specifications of the document scanner which is housing the fluorescent lamp. By constructing the substrate 125 in this manner, the harness reduces the variability of resistance achieved through the elimination of the conventional intermediate connector.

Furthermore, a light blocking material 1132 is provided on the substrate 125 to enable a uniform illumination profile along the length of the lamp. In the preferred embodiment, the substrate 125 is transparent, with narrow metal resistive traces 1130 and 1131 forming the heater element 113. The traces 1130 and 1131 are formed photolithgraphically from a metal coated clear substrate to form a S-shaped pattern that traverses substantially the entire lamp. More specifically, traces 1131 run perpendicular to the lamp's axis, while the traces 1130 run parallel to the lamp's axis. In addition to the traces 1130 and 1131, the substrate 125 includes areas of metal 1132, electrically isolated from the heater traces 1130 and 1131, for the purpose of blocking light. The fractional area of the metal 1132 left is proportional to the amount of profile correction to be made.

FIG. 4 illustrates a heater/lamp power harness for a fluorescent lamp. In this embodiment, the heater/lamp power harness includes an electrically insulating substrate 125 upon which a heating element 113 is formed. The electrically insulating substrate 125, as in FIG. 3, also has formed upon it a pair of power traces 132 which form an electrical path to supply power to the heating element 113. Furthermore, the electrically insulating substrate 125 has formed upon it two pairs of power traces 130 which form electrical paths to supply power to a fluorescent lamp and to the lamp filaments.

The electrically insulating substrate 125, in this embodiment, has two integral portions, a lamp portion which provides electrical insulation and support for the heating element 113, electrical connection pads 121, and portions of power traces 130 and a tail portion 126 ("harness tail 126") which provides electrical insulation and support for the heating element power traces 132 and the lamp power traces 130 and enables the heating element power traces 132 and the lamp power traces 130 to be lead away from the heating element portion. The harness tail 126 may have a connector placed at its end (not shown) so as to enable connection to a power source. In the preferred embodiment, the end of the harness tail 126 is stripped leaving bare traces. These traces are then inserted into the power source when the tail is long enough or into a scan cord when the tail is short.

The harness tail 126 may be short so that a cord is required from the power source to the connector on the end of the harness tail 126, or the harness tail 126 may be long enough to provide a direct power path from the power source to the lamp. The length of the harness tail may be adjusted to meet the specifications of the document scanner which is housing the fluorescent lamp. By constructing the substrate 125 in this manner, the harness reduces the variability of resistance achieved through the elimination of the conventional intermediate connector.

Furthermore, a light blocking material 1132 is provided on the substrate 125 to enable a uniform illumination profile along the length of the lamp. In the preferred embodiment, the substrate 125 is transparent, with narrow metal resistive traces 1130 and 1131 forming the heater element 113. The traces 1130 and 1131 are formed photolithgraphically from a metal coated clear substrate to form a S-shaped pattern that traverses substantially the entire lamp. More specifically, traces 1131 run perpendicular to the lamp's axis, while the traces 1130 run parallel to the lamp's axis. In addition to the traces 1130 and 1131, the substrate 125 includes areas of metal 1132, electrically isolated from the heater traces 1130 and 1131, for the purpose of blocking light. The fractional area of the metal 1132 left is proportional to the amount of profile correction to be made.

FIG. 5 illustrates another embodiment of the heater/lamp power harness for a fluorescent lamp. In this embodiment, the heater/lamp power harness includes an electrically insulating substrate 125 upon which a heating element 113 is formed. The electrically insulating substrate 125, as in FIG. 4, also has formed upon it a pair of power traces 132 which form an electrical path to supply power to the heating element 113 and two pairs of power traces 130 which form electrical paths to supply power to a fluorescent lamp and to the lamp filaments.

The electrically insulating substrate 125, in this embodiment, has two integral portions, a lamp portion which provides electrical insulation and support for the heating element 113 and a tail portion 126 ("harness tail 126") which provides electrical insulation and support for the heating element power traces 132 and the lamp power traces 130 and enables the heating element power traces 132 and the lamp power traces 130 to be lead away from the heating element portion. The lamp power traces 130 are not formed on the lamp portion of the electrically insulating substrate 125 to allow flexibility in connecting the power to the fluorescent lamp. The harness tail 126 may have a connector placed at its end (not shown) so as to enable connection to a power source. In the preferred embodiment, the end of the harness tail 126 is stripped leaving bare traces. These traces are then inserted into the power source when the tail is long enough or into a scan cord when the tail is short.

The harness tail 126 may be short so that a cord is required from the power source to the connector on the end of the harness tail 126, or the harness tail 126 may be long enough to provide a direct power path from the power source to the lamp. The length of the harness tail may be adjusted to meet the specifications of the document scanner which is housing the fluorescent lamp. By constructing the substrate 125 in this manner, the harness reduces the variability of resistance achieved through the elimination of the conventional intermediate connector.

Furthermore, a light blocking material 1132 is provided on the substrate 125 to enable a uniform illumination profile along the length of the lamp. In the preferred embodiment, the substrate 125 is transparent, with narrow metal resistive traces 1130 and 1131 forming the heater element 113. The traces 1130 and 1131 are formed photolithgraphically from a metal coated clear substrate to form a S-shaped pattern that traverses substantially the entire lamp. More specifically, traces 1131 run perpendicular to the lamp's axis, while the traces 1130 run parallel to the lamp's axis. In addition to the traces 1130 and 1131, the substrate 125 includes areas of metal 1132, electrically isolated from the heater traces 1130 and 1131, for the purpose of blocking light. The fractional area of the metal 1132 left is proportional to the amount of profile correction to be made.

FIG. 6 illustrates a third embodiment of the heater/lamp power harness for a fluorescent lamp. In this embodiment, the heater/lamp power harness includes an electrically insulating substrate 125 upon which a heating element 113 is formed. The electrically insulating substrate 125, as in FIG. 4, also has formed upon it a pair of power traces 132 which form a electrical path to supply power to the heating element 113 and two pairs of power traces 130 which form electrical paths to supply power to a fluorescent lamp and to the lamp filaments. The harness further includes lamp holders 117 to receive the fluorescent lamp.

The electrically insulating substrate 125, in this embodiment, has three integral portions, a lamp portion which provides electrical insulation and support for the heating element 113, wing portions 127 which provide a mechanical connection for the lamp holders 117 and electrical insulation and support for portions of the lamp power traces 130, and a tail portion 126 ("harness tail 126") which provides electrical insulation and support for the heating element power traces 132 and the lamp power traces 130 and enables the heating element power traces 132 and the lamp power traces 130 to be lead away from the heating element portion. There are also air gaps 119 between the lamp portion and the lamp holders 117 to provide space for the ends of the fluorescent lamp (lamp bases). The harness tail 126 may have a connector placed at its end (not shown) so as to enable connection to a power source. In the preferred embodiment, the end of the harness tail 126 is stripped leaving bare traces. These traces are then inserted into the power source when the tail is long enough or into a scan cord when the tail is short.

The harness tail 126 may be short so that a cord is required from the power source to the connector on the end of the harness tail 126, or the harness tail 126 may be long enough to provide a direct power path from the power source to the lamp. The length of the harness tail may be adjusted to meet the specifications of the document scanner which is housing the fluorescent lamp. By constructing the substrate 125 in this manner, the harness reduces the variability of resistance achieved through the elimination of the conventional intermediate connector.

Furthermore, a light blocking material 1132 is provided on the substrate 125 to enable a uniform illumination profile along the length of the lamp. In the preferred embodiment, the substrate 125 is transparent, with narrow metal resistive traces 1130 and 1131 forming the heater element 113. The traces 1130 and 1131 are formed photolithgraphically from a metal coated clear substrate to form a S-shaped pattern that traverses substantially the entire lamp. More specifically, traces 1131 run perpendicular to the lamp's axis, while the traces 1130 run parallel to the lamp's axis. In addition to the traces 1130 and 1131, the substrate 125 includes areas of metal 1132, electrically isolated from the heater traces 1130 and 1131, for the purpose of blocking light. The fractional area of the metal 1132 left is proportional to the amount of profile correction to be made.

FIG. 7 illustrates a fourth embodiment of the heater/lamp power harness for a fluorescent lamp. In this embodiment, the heater/lamp power harness includes an electrically insulating substrate 125 upon which a heating element 113 is formed. The electrically insulating substrate 125, as in FIG. 4, also has formed upon it a pair of power traces 132 which form an electrical path to supply power to the heating element 113 and two pairs of power traces 130 which form electrical paths to supply power to a fluorescent lamp.

The electrically insulating substrate 125, in this embodiment, has three integral portions, a lamp portion which provides electrical insulation and support for the heating element 113, wing portions 127 which provide and electrical insulation and support for electrical connection pads 121 and portions of the lamp power traces 130, and a tail portion 126 ("harness tail 126") which provides electrical insulation and support for the heating element power traces 132 and the lamp power traces 130 and enables the heating element power traces 132 and the lamp power traces 130 to be lead away from the heating element portion. There are also air gaps 119 between the lamp portion and the electrical connection pads 121 on the wing portion to provide space for the ends of the fluorescent lamp. The harness tail 126 may have a connector placed at its end (not shown) so as to enable connection to a power source. In the preferred embodiment, the end of the harness tail 126 is stripped leaving bare traces. These traces are then inserted into the power source when the tail is long enough or into a scan cord when the tail is short.

The harness tail 126 may be short so that a cord is required from the power source to the connector on the end of the harness tail 126, or the harness tail 126 may be long enough to provide a direct power path from the power source to the lamp. The length of the harness tail may be adjusted to meet the specifications of the document scanner which is housing the fluorescent lamp. By constructing the substrate 125 in this manner, the harness reduces the variability of resistance achieved through the elimination of the conventional intermediate connector.

Furthermore, a light blocking material 1132 is provided on the substrate 125 to enable a uniform illumination profile along the length of the lamp. In the preferred embodiment, the substrate 125 is transparent, with narrow metal resistive traces 1130 and 1131 forming the heater element 113. The traces 1130 and 1131 are formed photolithgraphically from a metal coated clear substrate to form a S-shaped pattern that traverses substantially the entire lamp. More specifically, traces 1131 run perpendicular to the lamp's axis, while the traces 1130 run parallel to the lamp's axis. In addition to the traces 1130 and 1131, the substrate 125 includes areas of metal 1132, electrically isolated from the heater traces 1130 and 1131, for the purpose of blocking light. The fractional area of the metal 1132 left is proportional to the amount of profile correction to be made.

FIG. 8 illustrates a light source according to one embodiment of the present invention. In this embodiment, a fluorescent lamp 111 is utilized to produce light so as to illuminate the document being scanned. The fluorescent lamp 111 is surrounded by a heating blanket (not shown) which includes a heating element 113. The heating blanket surrounds essentially the entire fluorescent lamp 111 except for a small slit which enables the light produced by the fluorescent lamp 111 to pass therethrough and illuminate the document being scanned. In an alternative preferred embodiment, the heating blanket surrounds the entire fluorescent lamp 111 and is substantially transparent so as to enable the light produced by the fluorescent lamp 111 to pass therethrough and illuminate the document being scanned.

The heating element 113 provides a stable temperature gradient along the fluorescent lamp so that the light produced by the fluorescent lamp is stable. At either end of the fluorescent lamp 111, lamp bases 120 are attached. These lamp bases 120 include pins 122. The lamp bases 120 including pins 122 provide mechanical support and electrical connectivity for the fluorescent lamp 111. More specifically, the lamp bases 120 including pins 122 are received by fluorescent lamp holders (not shown) attached to the document scanner wherein the fluorescent lamp holders include receptacles for pins 122 which provide an electrical connection to the fluorescent lamp 111.

The fluorescent lamp 111 also has attached thereto an electrically insulating substrate 125 upon which a plurality of power traces 132 and 130 are formed. More specifically, a pair of power traces 132 are formed on the electrically insulating substrate 125 wherein these power traces 132 are directly connected to the heating element 113. Thus, in this embodiment, the user merely needs to connect the harness tail 126 to a connector which will provide the power to the heating element and the lamp. As noted before, the harness tail 126 may be short so that a cord is provided from the power source to the connector on the end of the harness tail 126, or the harness tail 126 may be long enough to provide a power path from the power source to the lamp. It is noted that the electrically insulating substrate 125 can be modified to resemble the substrate illustrated in FIG. 6.

The electrically insulating substrate 125 also includes two pairs of power traces 130 which are connected to electrical conductors 124 which provide the actual power to the fluorescent lamp to enable illumination. The electrical conductors 124 are connected to the fluorescent lamp holders (not shown) of the document scanner so that the electric power can be transferred to the fluorescent lamp. It is noted that the power traces 130 and 132 formed on the electrically insulating substrate are substantially flat.

In the embodiment illustrated in FIG. 8, the fluorescent light source is an integral device which includes the fluorescent lamp 111, the heating element 113, and the electrically insulating substrate 125 which provides a platform upon which the power traces for the various components of the fluorescent lamp are formed and supported.

Furthermore, a light blocking material 1132 is provided on the substrate 125 to enable a uniform illumination profile along the length of the lamp. In the preferred embodiment, the substrate 125 is transparent, with narrow metal resistive traces 1130 and 1131 forming the heater element 113. The traces 1130 and 1131 are formed photolithgraphically from a metal coated clear substrate to form a S-shaped pattern that traverses substantially the entire lamp. More specifically, traces 1131 run perpendicular to the lamp's axis, while the traces 1130 run parallel to the lamp's axis. In addition to the traces 1130 and 1131, the substrate 125 includes areas of metal 1132, electrically isolated from the heater traces 1130 and 1131, for the purpose of blocking light. The fractional area of the metal 1132 left is proportional to the amount of profile correction to be made.

FIG. 9, as noted above, illustrates another embodiment of the light source according to the concepts of the present invention. In this embodiment, a fluorescent lamp 111 is utilized to produce light so as to illuminate the document being scanned. The fluorescent lamp 111 is surrounded by a heating blanket (not shown) which includes a heating element 113. The heating blanket surrounds essentially the entire fluorescent lamp except for a small slit which enables the light produced by the fluorescent lamp to pass therethrough and illuminate the document being scanned. In an alternative preferred embodiment, the heating blanket surrounds the entire fluorescent lamp 111 and is substantially transparent so as to enable the light produced by the fluorescent lamp 111 to pass therethrough and illuminate the document being scanned. The heating element 113 provides a stable temperature gradient along the fluorescent lamp so that the light produced by the fluorescent lamp is stable.

In contrast with the embodiment illustrated in FIG. 8, the light source of FIG. 9 does not include lamp bases 120 with pins 122. Instead, electrical leads 224 provide electric power to the fluorescent lamp 111 directly from the pair of electric leads 130 which are formed on the electrically insulating substrate 125 upon which a plurality of pair of power traces are formed. More specifically, a pair of power traces 132 are formed on the electrically insulating substrate 125 wherein these power traces 132 are directly connected to the heating element 113. Thus, in this embodiment, the user merely needs to connect the harness tail 126 to a connector which will provide the power to the heating element and the lamp. As noted before, the harness tail 126 may be short so that a cord is provided from the power source to the connector on the end of the harness tail 126, or the harness tail 126 may be long enough to provide a power path from the power source to the lamp. It is noted that the electrically insulating substrate 125 can be modified to resemble the substrate illustrated in FIG. 7.

In the embodiment illustrated in FIG. 9, the fluorescent light source is an integral device which includes the fluorescent lamp 111, the heating element 113, and the electrically insulating substrate 125 which provides a platform upon which the power traces for the various components of the fluorescent lamp are formed and supported.

Furthermore, a light blocking material 1132 is provided on the substrate 125 to enable a uniform illumination profile along the length of the lamp. In the preferred embodiment, the substrate 125 is transparent, with narrow metal resistive traces 1130 and 1131 forming the heater element 113. The traces 1130 and 1131 are formed photolithgraphically from a metal coated clear substrate to form a S-shaped pattern that traverses substantially the entire lamp. More specifically, traces 1131 run perpendicular to the lamp's axis, while the traces 1130 run parallel to the lamp's axis. In addition to the traces 1130 and 1131, the substrate 125 includes areas of metal 1132, electrically isolated from the heater traces 1130 and 1131, for the purpose of blocking light. The fractional area of the metal 1132 left is proportional to the amount of profile correction to be made.

Figure 10:
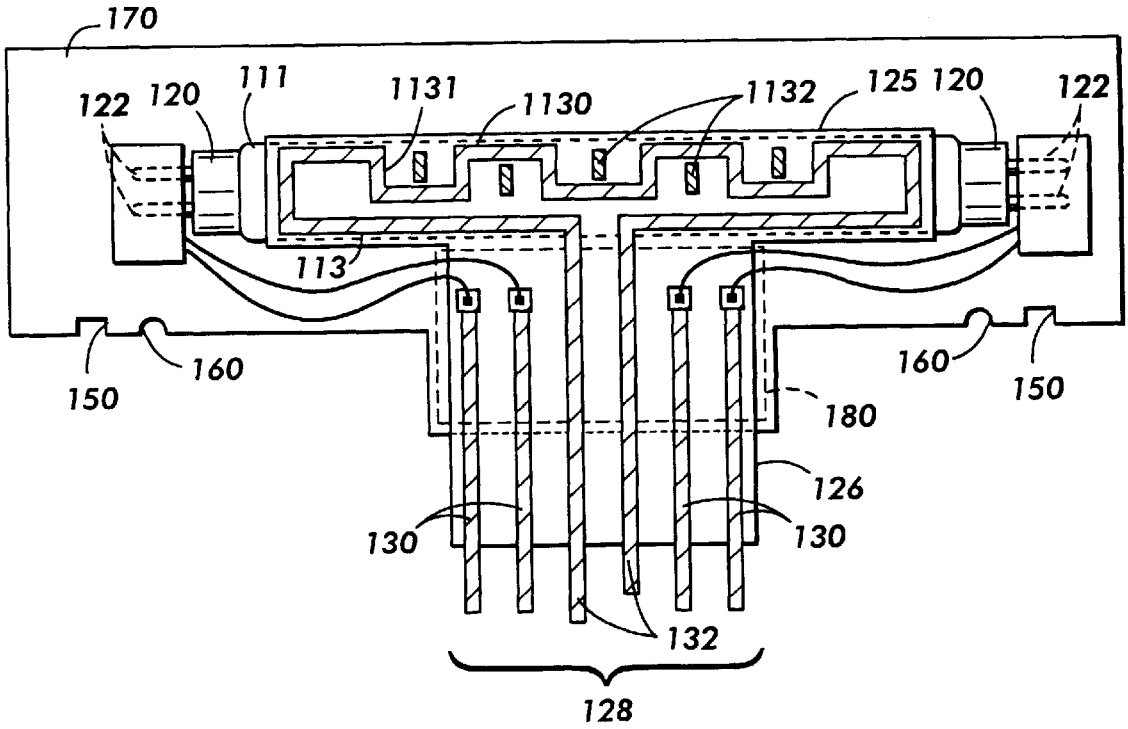
FIG. 10 illustrates a replaceable fluorescent lamp unit for a document scanner according to the concepts of the present invention.

FIG. 10, as noted above, illustrates a replaceable fluorescent lamp unit for a document scanner. This replaceable fluorescent lamp unit includes a housing 170 upon which fluorescent lamp holders 117 are integrally attached. Connected to the fluorescent lamp holders 117 are lamp bases 120 of a fluorescent lamp 111 which include pins 122. The lamp bases 120, including pins 122, provide mechanical support and electrical connectivity for the fluorescent lamp 111. More specifically, the lamp bases 120, including pins 122, are received by fluorescent lamp holders 121 wherein the fluorescent lamp holders include receptacles for pins 122 which provide an electrical connection to the fluorescent lamp 111.

The fluorescent lamp 111, as also illustrated in FIGS. 8 and 9, is substantially surrounded by a heater blanket which includes a heating element 113. The heating blanket surrounds essentially the entire fluorescent lamp except for a small slit which enables the light produced by the fluorescent lamp to pass therethrough and illuminate the document being scanned. In an alternative preferred embodiment, the heating blanket surrounds the entire fluorescent lamp 111 and is substantially transparent so as to enable the light produced by the fluorescent lamp 111 to pass therethrough and illuminate the document being scanned. The heating element 113 provides a stable temperature gradient along the fluorescent lamp so that the light produced by the fluorescent lamp is stable.

The fluorescent lamp 111 also has attached thereto an electrically insulating substrate 125 upon which a plurality of pairs of power traces are formed. More specifically, a pair of power traces 132 are formed on the electrically insulating substrate 125 wherein these power traces 132 are directly connected to the heating element 113. Thus, in this embodiment, the user merely needs to connect the harness tail 126 to a connector which will provide the power to the heating element and the lamp. As noted before, the harness tail 126 may be short so that a cord is required from the power source to the connector on the end of the harness tail 126, or the harness tail 126 may be long enough to provide a power path from the power source to the lamp.

The electrically insulating substrate 125 also includes two pairs of power traces 130 which are connected to electrical conductors 124 which are in turn connected to the fluorescent lamp holders 117 to provide the actual power to the fluorescent lamp which enables illumination.

The housing 170 further includes notches 150 which provide proper registration of the light source in the document scanner and notches 160 which enable the light source to be properly secured to the document scanner. Lastly, the replaceable fluorescent lamp unit may include a mylar pad 180 which provides further electrical insulation for the traces 130 and 132 from the housing 170 by sandwiching the traces between electrically insulating substrate 125 and the mylar pad 180. It is noted that this mylar pad may be part of the embodiments illustrated in FIGS. 5,8, and 9.

The fluorescent light source is an integral component of the fluorescent lamp unit which includes the fluorescent lamp 111, the heating element 113, and the electrically insulating substrate 125 which provides a platform upon which the power traces for the various components of the fluorescent lamp are formed and supported.

In the embodiment illustrated in FIG. 10, when a user wishes to replace the light source in a document scanner, the user removes the entire fluorescent lamp replaceable unit and replaces it with a similar unit. This way, the user can easily replace the light source while maintaining the light source's proper position and registration within the document scanner. Moreover, the user merely needs to connect the harness tail 126 to a connector which will provide the power to the heating element and the lamp.

Furthermore, a light blocking material 1132 is provided on the substrate 125 to enable a uniform illumination profile along the length of the lamp. In the preferred embodiment, the substrate 125 is transparent, with narrow metal resistive traces 1130 and 1131 forming the heater element 113. The traces 1130 and 1131 are formed photolithgraphically from a metal coated clear substrate to form a S-shaped pattern that traverses substantially the entire lamp. More specifically, traces 1131 run perpendicular to the lamp's axis, while the traces 1130 ran parallel to the lamp's axis. In addition to the traces 1130 and 1131, the substrate 125 includes areas of metal 1132, electrically isolated from the heater traces 1130 and 1131, for the purpose of blocking light. The fractional area of the metal 1132 left is proportional to the amount of profile correction to be made.

In all the embodiments described above, the harness tail 126 may be used for a simple electrical connection to a separate scan cord, or, it may also be used as a flexible scan cord, supplying an electrical connection to a stationary power supply during the scanning operation. Moreover, in the embodiments described above, the lamp power traces may be a pair of conductors, as illustrated, which supply power to either end of the lamp when the lamp has heating filaments, or the lamp power traces may be a single pair of conductors wherein one conductor goes to one end of the lamp and the other conductor goes to the other end of the lamp because the lamp has no heating filaments.

Although the present invention has been described in detail above, various modifications can be made without departing from the spirit of the invention. For example, the above description describes the present invention as having the heater and lamp power traces being formed on the same substrate. As an alternative, the lamp power traces can be formed on a separate substrate and then bonded to the substrate containing the heater element traces. Moreover, the light blocking elements may be formed directly on the lamp instead of on the heating blanket.

In summary, the present invention provides a fluorescent lamp or light source for a document scanner which can be easily connected and disconnected by the user that uses light blocking features to provide a more uniform illumination profile.

While the present invention has been described with reference to various embodiments as described above, it is not confined to the details set forth above, but is intended to cover such modifications or changes as may come within the scope to the attached claims.

What is claimed is:

1. A lamp harness assembly, comprising:

a heating element;

a plurality of light blocking elements; and an electrically insulating substrate;

said electrically insulating substrate having said heating element and said plurality of light blocking elements formed thereon;

said heating element being formed by a plurality of parallel heating element traces and a plurality of perpendicular heating element traces, thereby forming a squared S-shaped heating element on said electrically insulating substrate.

2. The lamp harness assembly as claimed in claim 1, wherein said plurality of light blocking elements are positioned in areas of said electrically insulating substrate that are located between said perpendicular heating element traces.

3. The lamp harness assembly as claimed in claim 2, wherein areas of said electrically insulating substrate that are located at an end portion of the lamp harness assembly are unblocked by any light blocking elements.

4. The lamp harness assembly as claimed in claim 1, wherein a width dimension of a light blocking element is proportional to a profile correction factor and a difference between a width dimension of a perpendicular heating element trace and a spacing distance between centers of adjacent light blocking elements.

5. The lamp harness assembly as claimed in claim 1, wherein each light blocking element is constructed of metal.

6. A lamp harness assembly, comprising:

a heating element;

heating element power traces;

a plurality of light blocking elements; and an electrically insulating substrate;

said electrically insulating substrate having said heating element, heating element power traces, and said plurality of light blocking elements formed thereon;

said electrically insulating substrate including, a lamp portion having said heating element and said plurality of light blocking elements formed thereon, and a tail portion having said heating element power traces formed thereon;

said tail portion extending away from said lamp portion to provide an electrical connection to a power source;

said heating element being formed by a plurality of parallel heating element traces and a plurality of perpendicular heating element traces, thereby forming a squared S-shaped heating element on said electrically insulating substrate.

7. The lamp harness assembly as claimed in claim 6, wherein said plurality of light blocking elements are positioned in areas of said electrically insulating substrate that are located between said perpendicular heating element traces.

8. The lamp harness assembly as claimed in claim 7, wherein areas of said electrically insulating substrate that are located at an end portion of the lamp harness assembly are unblocked by any light blocking elements.

9. The lamp harness assembly as claimed in claim 6, wherein a width dimension of a light blocking element is proportional to a profile correction factor and a difference between a width dimension of a perpendicular heating element trace and a spacing distance between adjacent light blocking elements.

10. The lamp harness assembly as claimed in claim 6, wherein each light blocking element is constructed of metal.

11. A fluorescent light source, comprising:

a fluorescent lamp;

an electrically insulating substrate connected to said fluorescent lamp;

a heating blanket positioned on said fluorescent lamp, having a heating element;

a plurality of light blocking elements positioned on said heating blanket;

a first pair of power traces formed on said electrically insulating substrate and connected to said heating element to provide power thereto;

a second pair of power traces formed on said electrically insulating substrate; and a pair of electrical conductors connected to said second pair of power traces to provide power to said fluorescent lamp;

said heating element being formed by a plurality of parallel heating element traces and a plurality of perpendicular heating element traces, thereby forming a squared S-shaped heating element on said heating blanket.

12. The fluorescent light sources as claimed in claim 11, wherein said plurality of light blocking elements are positioned in areas of said heating blanket that are located between said perpendicular heating element traces.

13. The fluorescent light source as claimed in claim 12, wherein areas of said electrically insulating substrate that are located at an end portion of said fluorescent lamp are unblocked by any light blocking elements.

14. The fluorescent light source as claimed in claim 11, wherein each light blocking element is constructed of metal.

15. An illumination source, comprising:

a fluorescent lamp; and a plurality of light blocking elements;

said plurality of light blocking elements are positioned in close proximity to said fluorescent lamp;

said plurality of light blocking elements each having a length dimension and a width dimension, said length dimension being greater than said width dimension;

said plurality of light blocking elements being positioned such that said length dimension is perpendicular to an axis of said fluorescent lamp;

said width dimension of a light blocking element being proportional to a profile correction factor and a spacing distance between adjacent light blocking elements.

16. The illumination source as claimed in claim 15, wherein each light blocking element is constructed of metal.

17. A fluorescent lamp assembly, comprising:

a fluorescent lamp;

a plurality of light blocking elements; and a heating blanket;

said plurality of light blocking elements are positioned in close proximity to said fluorescent lamp;

said plurality of light blocking elements each having a length dimension and a width dimension, said length dimension being greater than said width dimension;

said plurality of light blocking elements being positioned such that said length dimension is perpendicular to an axis of said fluorescent lamps;

said width dimension of a light blocking element being proportional to a profile correction factor and a spacing distance between adjacent light blocking elements.

18. The fluorescent lamp assembly as claimed in claim 17, wherein each light blocking element is constructed of metal.

19. A replaceable fluorescent light source unit, comprising:

a housing;

lamp base receiving members attached to said housing;

a fluorescent lamp having lamp bases attached to opposite ends thereof and removably attached to said lamp base receiving members;

an electrically insulating substrate connected to said fluorescent lamp;

a heating element positioned on said fluorescent lamp;

a first pair of power traces formed on said electrically insulating substrate and connected to said heating element to provide power thereto;

a second pair of power traces formed on said electrically insulating substrate;

a pair of electrical conductors connected to said second pair of power traces and one of said lamp base receiving means to provide power to said fluorescent lamp; and a plurality of light blocking elements;

said plurality of light blocking elements are positioned in close proximity to said fluorescent lamp;

said plurality of light blocking elements each having a length dimension and a width dimension, said length dimension being greater than said width dimension;

said plurality of light blocking elements being positioned such that said length dimension is perpendicular to an axis of said fluorescent lamp;

said heating element being formed on said electrically insulating substrate;

said plurality of light blocking elements being formed on said electrically insulating substrate;

said heating element being formed by a plurality of parallel heating element traces and a plurality of perpendicular heating element traces, thereby forming a squared S-shaped heating element on said electrically insulating substrate.

20. The replaceable fluorescent light source unit as claimed in claim 19, wherein said plurality of light blocking elements are positioned in areas of said electrically insulating substrate that are located between said perpendicular heating element traces.

21. The replaceable fluorescent light source unit as claimed in claim 20, wherein areas of said electrically insulating substrate that are located at an end portion of said fluorescent lamp are unblocked by any light blocking elements.

22. The replaceable fluorescent light source unit as claimed in claim 19, wherein a width dimension of a light blocking element is proportional to a profile correction factor and a difference between a width dimension of a perpendicular heating element trace and a spacing distance between adjacent light blocking elements.

23. The replaceable fluorescent light source unit as claimed in claim 19, wherein each light blocking element is constructed of metal.

* * * * *